United States Patent [19]

Schall

[11] Patent Number: 4,735,714

[45] Date of Patent: Apr. 5, 1988

[54] RIBBED FACEPLATE FOR SWIMMING POOL AND SPA SKIMMER APPARATUS

[75] Inventor: Frederick R. Schall, Mount Laurel, N.J.

[73] Assignee: Esther Williams Swimming Pools, Delair, N.J.

[21] Appl. No.: 7,674

[22] Filed: Jan. 28, 1987

[51] Int. Cl.[4] ..... E04H 3/16

[52] U.S. Cl. ..... 210/169; 4/512

[58] Field of Search ..... 210/169, 242.1, 166, 210/538, 416.1; 4/490, 510, 512

[56] References Cited

U.S. PATENT DOCUMENTS 2,701,235 2/1955 King ..... 210/169

2,861,692 11/1958 Humphreys ..... 210/538

3,765,534 10/1973 West et al. ..... 210/169

4,303,520 12/1981 Wirt ..... 210/242.1

4,498,984 2/1985 Colson ..... 210/169

*Primary Examiner*—Peter Hruskoci

*Assistant Examiner*—Coreen Y. Lee

*Attorney, Agent, or Firm*—Jay M. Cantor

[57] ABSTRACT

The disclosure relates to a face plate for use in conjunction with the skimmer apparatus for recreational devices, such as swimming pools and spas, wherein the face plate for the fitting positioned in the swimming pool wall and extending into the swimming pool includes a plurality of ribs on each leg thereof to prevent closure of the aperture from the pool to the skimmer apparatus.

8 Claims, 2 Drawing Sheets

RIBBED FACEPLATE FOR SWIMMING POOL AND SPA SKIMMER APPARATUS

BACKGROUND OF THE INVENTION

1. Field of the Invention

This invention relates to apparatus for skimming debris and the like from the surface of the water in swimming pools and spas and, more specifically, to a ribbed face plate for use in conjunction with such apparatus.

2. Brief Description of the Prior Art

Systems for skimming debris and the like from the surface of the water in swimming pools, spas and the like normally entail the use of a rectangular aperture in the swimming pool side wall at or closely below the water surface with the open sided fitting portion of the skimmer apparatus positioned in the aperture and the remainder of the skimmer apparatus positioned on the outer side of the pool wall. Such open side of the fitting is normally surrounded by gaskets, usually two in number, and a flat face plate over the gaskets which is held in place with a number of screws which are secured in the fitting. A water pump or the like, which is attached to the filter apparatus, sucks water from the pool surface, along with debris and the like on the water surface, through the aperture, to the water cleaning equipment, such as filters and the like, as is well known, and then returns the filtered and otherwise cleaned water to the swimming pool.

The face plates are frequently supplied with an air vent at the top thereof so that, in the event a person seals of the face of the skimmer, i.e., the aperture, the air vent will allow the water in the skimmer to be pumped out, whereby the air entering the pump will break the prime of the pump, causing cavitation and, hopefully, not entrapping a person thereagainst due to the suction. It has also been observed that, on occasion, individuals will cover the air vents to prevent the water from splashing out or the vent may become unintentionally covered. Even when the air vent is functioning properly, there is a pressure differential between the water in the pool and the aperture, thereby potentially causing small children and the like to become trapped against the aperture and held thereagainst.

It is therefore readily apparent that some mechanism which would prevent the total blockage of the aperture is desirable in order to minimize the possibility of an individual becoming entrapped against the aperture as is possible with present day prior art face plates and skimmer mechanisms.

SUMMARY OF THE INVENTION

In accordance with the present invention, the above noted problems inherent in prior art skimmer systems are minimized and there is provided a ribbed face plate for use in conjunction with such skimmer mechanisms which materially reduces the possibility of of entrapment thereagainst.

Briefly, in accordance with the present invention, there is provided a face plate, which replaces the above described face plate of the prior art pool skimmer systems, wherein a plurality of ribs are formed about the periphery of the face plate. The ribs can be integral with the face plate and form a single element therewith. The ribs surround the aperture and, preferably, all extend toward the aperture, being normal to the major axis of the side of the face plate on which they are positioned. The ribs extend outwardly from the face plate a relatively short distance, approximately ⅜ inch being a preferred distance therefor. Therefore, if a person leans against the ribbed face plate, no sealing off of the aperture will take place, contrary to a likely condition with the above described prior art face plate. Accordingly, since the aperture cannot be sealed off due to the areas around the ribs wherethrough water can travel, there will be no sealing off of the flow of water between the ribs or veins to the skimmer pump and, accordingly, there will be no reduction in water flow to the skimmer. This will also reduce the suction against a person or article coming in contact with the ribbed face plate and prevent same from becoming trapped thereagainst.

DESCRIPTION OF THE PREFERRED EMBODIMENT

Figure 1:
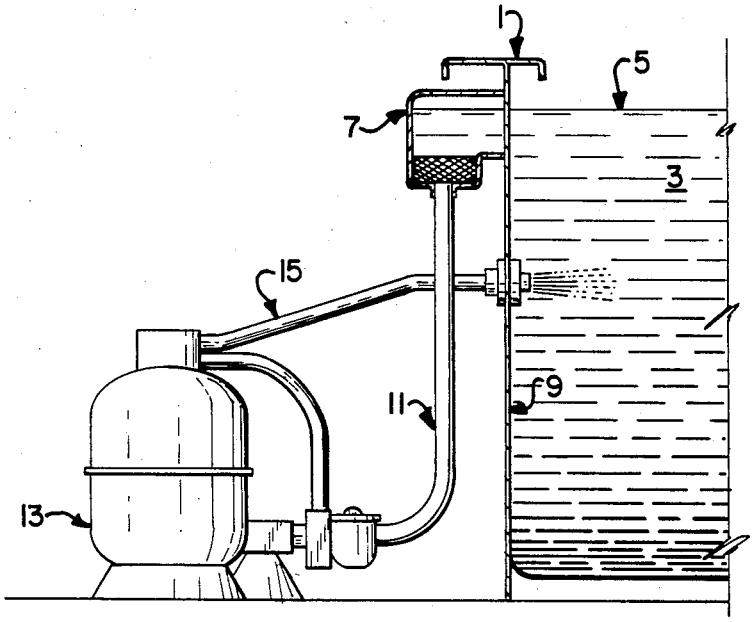
FIG. 1 is a schematic diagram of a swimming pool skimmer apparatus in accordance with the prior art.

Referring first to FIG. 1, there is shown a standard swimming pool with standard skimmer apparatus for removal of debris and the like from the water surface. While the preferred embodiment herein will be described with respect to a swimming pool, it should be understood that the invention can be used in conjunction with any recreational or other device wherein a suction is involved, such as in spas, hot tubs and the like.

Figure 2:
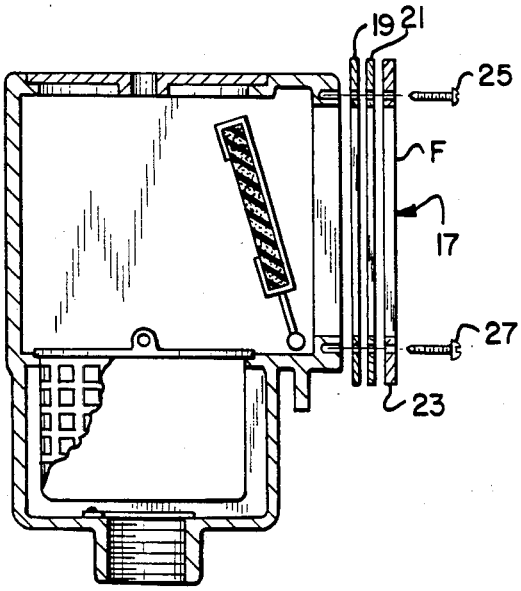
FIG. 2 is a cross sectional view of a prior art skimmer apparatus fitting with gaskets and face plate.

There is shown the swimming pool 1 having water 3 therein having a water surface 5. A prior art fitting 7, shown in greater detail in FIG. 2, is secured to a wall 9 of the pool 1, the fitting being connected by a pipe 11 to filter apparatus 13 external of the pool wherein the water is filtered and/or otherwise treated. The filtered and/or otherwise treated water is then returned to the pool via pipe 15. The fitting includes an open end 17 which is mounted in an aperture in the side wall 9 of the swimming pool. The fitting end walls defining the aperture 17 have disposed thereearound first and second gaskets 19 and 21 and a face plate 23. The face plate bears against the gaskets and is held secured against the fitting 7 by screws 25 and 27 which are secured in the fitting, pass through the face plate 23 and gaskets 19 and 21 and bear against the face plate. As can be seen, the face plate of the prior art as depicted in FIGS. 1 and 2 is of flat and annular construction.

Since a suction action will be present at the aperture 17 of the fitting 7, and since the aperture 17 is usually positioned at or close to the surface of the water 5 as shown in FIG. 1, debris at the water surface as well as surface water will be sucked into the aperture for operation thereon in the skimmer apparatus 13 as noted hereinabove. However, as is readily apparent, anything else that is in the vicinity of the aperture 17 will also have a suction action applied thereto and be carried toward the aperture. This action can cause a clogging of the opening to the aperture in the case of large objects which cannot fit therethrough, thereby causing potential damage to the skimmer apparatus and can cause harm to small children and the like who are unable to extricate themselves from the suction action and become entrapped against the aperture.

Figure 3:
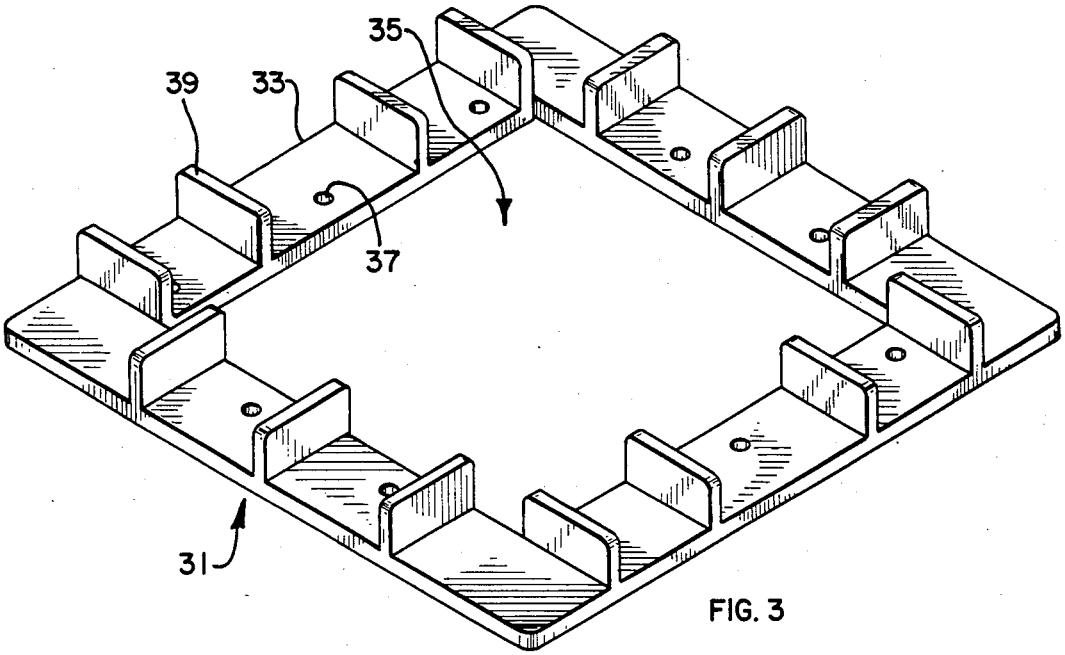
FIG. 3 is a perspective view of a face plate in accordance with the present invention.

This problem of the prior art is substantially minimized by use of the novel face plate 31 in accordance with the present invention as shown in FIG. 3. The face plate of FIG. 3 is a direct replacement for the face plate of FIGS. 1 and 2. The face plate includes a rectangular member 33, preferably formed of a rigid, non-rusting material, such as plastic, and having a large central aperture 35 which is the same as the aperture in the face plate 23. A plurality of holes 37 are disposed about the rectangular section to receive screws therethrough such as the screws 25 and 27 of FIG. 2. A plurality of ribs 39 are formed on each side of the rectangular member 33. The ribs 39 are preferably integral with the rectangular member 33, the rectangular member and ribs preferably being formed is a single unit. The ribs are preferably disposed on the rectangle in a direction toward the aperture 35 and are preferably normal to the major axis of the side of the rectangle on which they are disposed.

It can be seen that, with the use of the face plate 31 of FIG. 3 in place of the face plate 23 of FIGS. 1 and 2, the movement of large objects against the face plate will not be capable of completely blocking the aperture 17 in the swimming pool side. This will permit water to continue to flow to the skimmer apparatus 13 and prevent potential damage thereto. In addition, due to the flow of water around the ribs at all times, small children and the like will be subjected to a decreased suction against the ribs 39 as opposed to the face plate 23, thereby having an improved opportunity to extricate themselves from the suction action of the skimmer apparatus.

It can be seen that there has been provided an improved face plate for use in conjunction with a skimmer apparatus which is simple and can operate as a direct replacement for the prior art face plate without necessity for alteration of the prior art system.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. A skimmer apparatus for a recreational device which comprises:

(a) a fitting mountable in the sidewall of a water containing recreational device and having an open end portion, (b) suction means coupled to said fitting for providing a vacuum condition at said open portion, (c) gasket means positioned about said opening, (d) a face plate bearing against said gasket means, and (e) means securing said face plate to said fitting and moving said face plate into a state of compression against said gasket means, said face plate comprising:

(f) a flat rectangular member formed of rigid, non-rusting material, (g) a rectangular aperture having a shape substantially similar to said rectangular member formed in said rectangular member and having a locus of point substantially the same as said rectangular member to define four legs of said rectangular member, and (h) a plurality of ribs formed on each of said legs and integral with said legs and extending in a direction toward said open portion and outwardly from said face plate in a direction normal to the major axis of the leg with which they are integral.

2. A skimmer apparatus as set forth in claim 1, further including a plurality of apertures extending through at least one of said legs to define screw holes therein.

3. A skimmer apparatus as set forth in claim 1, further including a plurality of apertures extending through at least one of said legs to define screw holes therein.

4. A skimmer apparatus as set forth in claim 1, further including a plurality of apertures extending through at least one of said legs to define screw holes therein.

5. A skimmer apparatus for a recreational device which comprises:

(a) a fitting mountable in the sidewall of a water containing recreational device and having an open end portion, (b) suction means coupled to said fitting for providing a vacuum condition at said open portion, (c) gasket means positioned about said opening, (d) a face plate bearing against said gasket means, and (e) means securing said face plate to said fitting and moving said face plate into a state of compression against said gasket means, said face plate comprising:

(f) a flat member formed of rigid, non-rusting material, (g) an aperture formed in said member and aligned with said open portion, and (h) a plurality of ribs formed on said member and extending in a direction toward said open portion and outwardly from said face plate in a direction normal to the major axis of the leg with which they are integral.

6. A skimmer apparatus as set forth in claim 5, further including a plurality of apertures extending through at least one of said legs to define screw holes therein.

7. A skimmer apparatus as set forth in claim 5, further including a plurality of apertures extending through at least one of said legs to define screw holes therein.

8. A skimmer apparatus as set forth in claim 5, further including a plurality of apertures extending through at least one of said legs to define screw holes therein.

* * * * *